US007665986B1

(12) United States Patent
Park

(10) Patent No.: US 7,665,986 B1
(45) Date of Patent: Feb. 23, 2010

(54) SYSTEM AND METHOD OF REPAIRING A WAX CANDLE HAVING A DIMINISHED WICK

(76) Inventor: Sang Ho Park, 3281 Salmon St., Philadelphia, PA (US) 19134-5921

( * ) Notice: Subject to any disclaimer, the term of this patent is extended or adjusted under 35 U.S.C. 154(b) by 353 days.

(21) Appl. No.: 11/267,543

(22) Filed: Nov. 7, 2005

(51) Int. Cl.
*F23D 3/02* (2006.01)

(52) U.S. Cl. ..... 431/298; 431/289

(58) Field of Classification Search ..... 431/298, 431/289, 288, 315, 290, 120; 99/564; 15/104.5, 15/104.062, 104.03; 30/105, 113.1, 113.3, 30/113.2

See application file for complete search history.

(56) References Cited

U.S. PATENT DOCUMENTS 2,117,278 A * 5/1938 Ainsworth ..... 30/113.1
2,263,531 A * 11/1941 Kevorkian ..... 30/301
4,201,540 A * 5/1980 Waymouth et al. ..... 431/361
6,630,110 B2 * 10/2003 Urfig ..... 422/125
6,688,880 B1 * 2/2004 Pangle ..... 431/289
6,896,511 B2 * 5/2005 Chadha ..... 431/289
7,070,409 B1 * 7/2006 Varrieur ..... 431/291
7,159,320 B2 * 1/2007 Moore ..... 30/113.1
2003/0134245 A1 * 7/2003 Jones ..... 431/288

FOREIGN PATENT DOCUMENTS

WO WO 2005/009517 A1 * 2/2005

* cited by examiner

*Primary Examiner*—Kenneth B Rinehart
*Assistant Examiner*—Chuka C Ndubizu
(74) *Attorney, Agent, or Firm*—LaMorte & Associates

(57) ABSTRACT

A system and method of repairing a wax candle having a diminished wick. A kit is provided having a coring device, a ramrod for displacing wax from the coring device and a length of replacement wick. The coring device is used to cut a core from the candle around the diminished wick. The coring device removes a core of wax from the candle, therein creating a bore in the candle. A length of replacement wick is then placed into the bore. The removed core of wax is then reinserted into the bore, thereby locking the replacement wick in place. The replacement wick extends above the wax and is trimmed to the proper height for use in lighting the candle.

8 Claims, 5 Drawing Sheets

SYSTEM AND METHOD OF REPAIRING A WAX CANDLE HAVING A DIMINISHED WICK

BACKGROUND OF THE INVENTION

1. Field of the Invention

In general, the present invention relates to tools and methods used to repair wax candles. More specifically, the present invention relates to tools and methods used to insert replacement wicks into candles.

2. Prior Art Description

Prior to the common use of electric lights, wax candles were the prominent source of light. Wax candles traditionally consist of some type of wax being molded around a cotton wick. The wick is lit with a match. As the wick burns, the wax near the wick melts and then vaporizes. The wax vapor is drawn into the flame of the wick, where it burns. The candle will therefore continue to burn for as long as the wax supply lasts.

In past years, wax candles were traditionally made long, thin and with a slight taper. Such a candle structure is highly efficient and produces a bright flame. Excess melted wax tends to run down the outside of the candle rather than pool around the wick. The wick is therefore free to burn uninhibited until it reaches the bottom of the candle and the wax supply is exhausted.

In modern society, candles are no longer widely used to as a primary source of light. Rather, candles are used as decorations, and are often lit merely to produce an aroma or accent lighting. Accordingly, many modern candles are manufactured to be short and wide. A short, wide candle is free standing and does not require a candle holder. Furthermore, short, wide candles provide large exterior surfaces that be decorated.

A problem associated with short, wide candles is that their structure prevents them from burning efficiently. This often leads to wick submersion. When a wick burns, the wick melts the wax nearest the wick. Thus, in a wide candle, a burning wick will only melt the wax near the wick, the wax at the periphery of the candle remains unaffected. A crater therefore forms around the wick as the wax is consumed, wherein the wick is centrally located at the bottom of the crater. Often, when the wick is lit, the burning wick will cause the walls of the crater to liquefy. The melted wax flows into the bottom of the crater and drowns the wick. As soon as a wick becomes submersed in wax, it is deprived of oxygen for combustion and the wick is extinguished.

Once the wick is submersed and is extinguished, the melted wax begins to harden. The wick therefore becomes entombed under the hardening wax. The candle cannot be relit because there is no exposed wick left to light. The buried wick must therefore be carved out of the wax before the candle can be reused.

When a wick is lost under the wax, it is common for a person to create another hole in the candle and insert a short secondary wick. This solution, however, is problematic. First, secondary wicks are typically short and do not descend to the bottom of the candle. The secondary wick will therefore only burn for a short time and will not burn with the entirety of the candle. Second, when a secondary wick is added to a candle and burned, the secondary wick consumes wax and the original wick again becomes exposed. The secondary wick ignites the original wick and two wicks now burn. The candle therefore becomes overly hot and burns at a greater speed than might be expected.

A need therefore exists for a simple system and method of repairing the wick of a candle once the wick becomes submersed in wax. This need is met by the present invention as described and claimed below.

SUMMARY OF THE INVENTION

The present invention is a system and method of repairing a wax candle having a diminished wick. A kit is provided having a coring device, a ramrod for displacing wax from the coring device and a length of replacement wick. The coring device is used to cut a core from the candle around the diminished wick. The coring device removes a core of wax from the candle, therein creating a bore in the candle. A length of replacement wick is then placed into the bore. The removed core of wax is then reinserted into the bore, thereby locking the replacement wick in place. The replacement wick extends above the wax and is trimmed to the proper height for use in lighting the candle.

As the replacement wick bur, the replacement wick joins with the remnants of the original wick. Accordingly, once the replacement wick burns away, the candle can continue to function using the remainder of the original wick.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Figure 1:
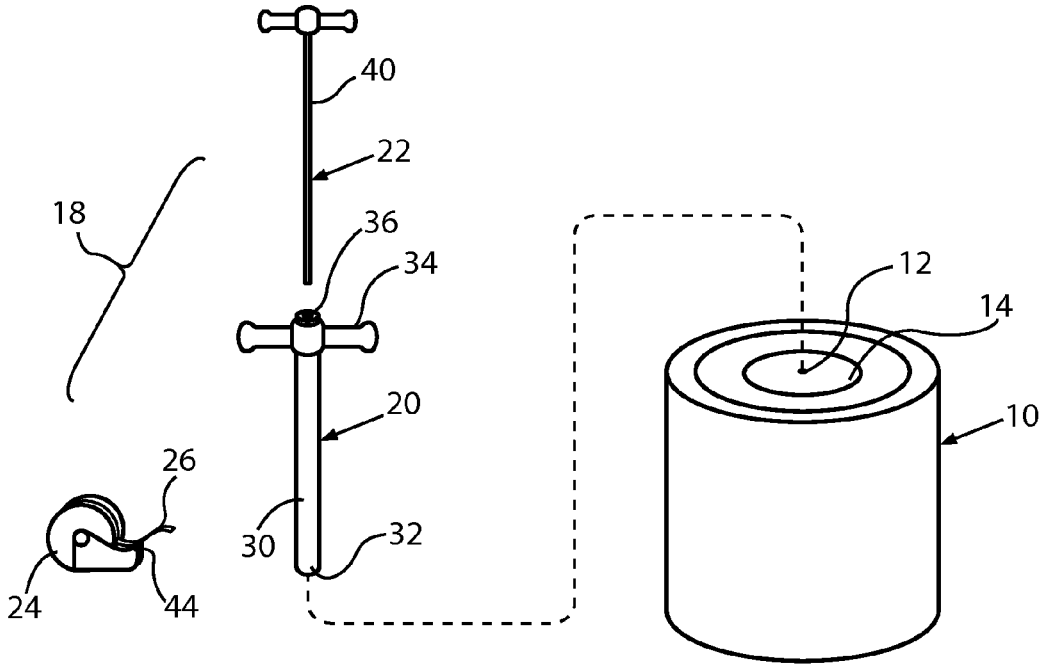
FIG. 1 is a perspective view of an exemplary embodiment of the present invention system shown in conjunction with a wax candle.

Referring to FIG. 1, there is shown a candle 10 having a wick 12 that has become submersed under the wax. No substantial part of the original wick 12 extends above the top surface 14 of the wax. Consequently, the candle 10 cannot be lit and is in need of repair.

The present invention system is comprised of three primary assemblies. These assemblies include a coring device 20, a ramrod 22 and a spool 24 of a replacement wick 26. The coring device 20 contains a hollow shaft 30. Cutting elements 32 are formed at the bottom end of the hollow shaft 30. The cutting elements 32 can be teeth or a simple sharpened edge that is oriented so that the hollow shaft 30 can cut into the wax of the candle 10 when pressed or rotated against the candle 10. A handle 34 is provided at the top of the hollow shaft 30 to help facilitate the advancement of the hollow shaft 30 into the wax of a candle 10. The hollow shaft 30 extends through the handle 34 so that a conduit 36 defined by the hollow shaft 30 remains unobstructed between two open ends.

The ramrod 22 consists of a solid shaft 40 having a diameter that allows the solid shaft 40 to pass into the hollow shaft 30 of the coring device 20. A handle 42 is also attached to the solid shaft 40 at its top end. The solid shaft 40 has an exposed length below the handle 42 that is at least as long as the hollow shaft 30 of the coring device 20.

The spool 24 of replacement wick 26 provides the length of replacement wick that will be used to supplement the original wick 12, which is submersed within the wax of the candle 10. The spool 24 of replacement wick 26 many include a cutting edge 44 to facilitate the cutting of the replacement wick 26 to different lengths.

Figure 2:
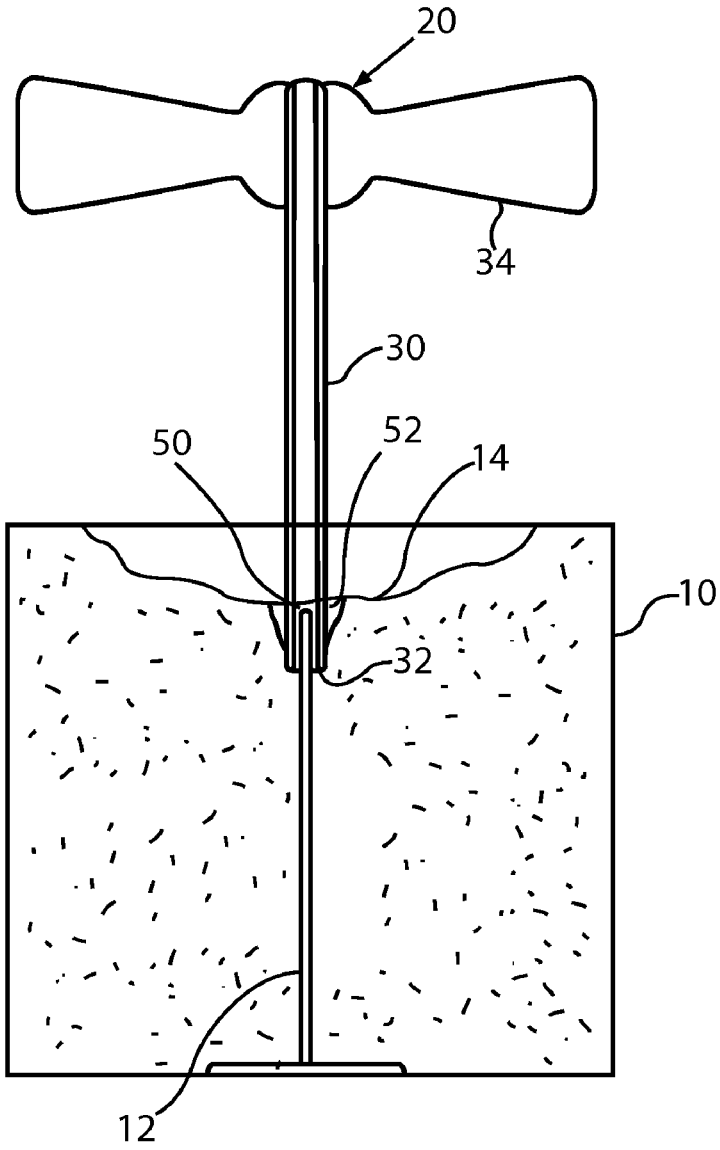
FIG. 2 is a cross-sectional view of the coring device of FIG. 1 creating a bore in a wax candle.

Referring to FIG. 2, it can be seen that to use the present invention system, the coring device 20 is placed onto the top surface 14 of the candle 10 above the original wick 12. The handle 34 of the coring device 20 is then turned and the cutting elements 32 at the end of the hollow shaft 30 cut into the wax of the candle 10. As the hollow shaft 30 cuts into the candle 12, a core cutting 50 passes into the conduit 36 of the hollow shaft 30. If properly aimed, the core cutting 50 will contain a segment of the original wick 12 and the wax immediately surrounding that segment of original wick 12.

The hollow shaft 30 is advanced into the candle 10 for at least one-half of an inch. Once at the proper depth, the hollow shaft 30 is wobbled about laterally to free the hollow shaft 30 from the surrounding wax. This widens the walls of the bore 52 created by the hollow shaft 30 so that the walls of the bore 52 are actually wider than the exterior of the hollow shaft 30. The coring device 20 is then pulled out of the candle 10, whereby the core cutting 50 is extracted from the candle 10.

Figure 3:
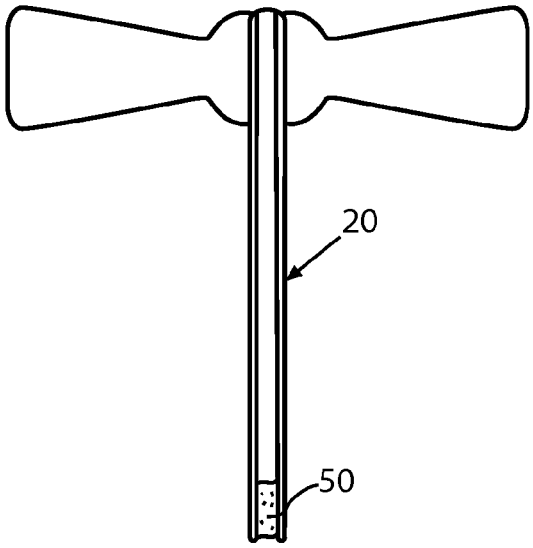
FIG. 3 is a cross-sectional view of the replacement wick of FIG. 1 being added to a cut bore.
Figure 3:
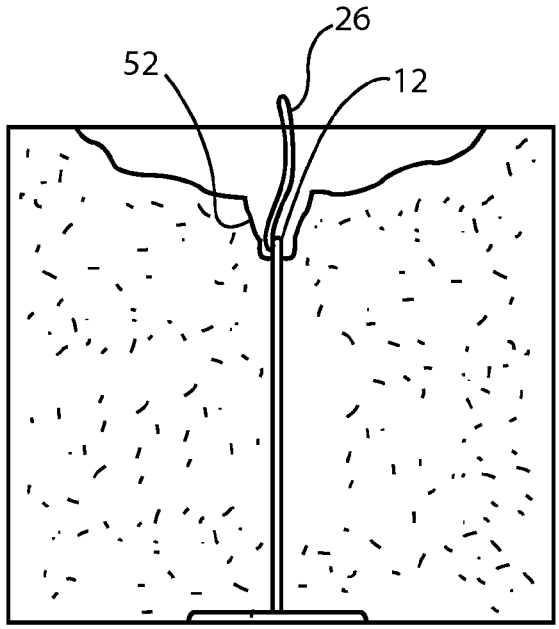

Referring to FIG. 3, it can be seen that when the core cutting 50 is extracted, a segment of the original wick 12 may remain in the candle. However, it is possible that the original wick 12 will break cleanly at the bottom of the bore 52 that was formed by the coring device 20. However, what happens most of the time is that a portion of the original wick 12 remains intact and extends into the newly created bore 52.

Once the core cutting 50 is removed, a length of replacement wick 26 is cut from the spool 24. The cut length of replacement wick 26 is then placed within the newly cut bore 52. Due to the narrowness of the bore 52, the length of replacement wick 26 generally aligns with the original wick 12.

Figure 4:
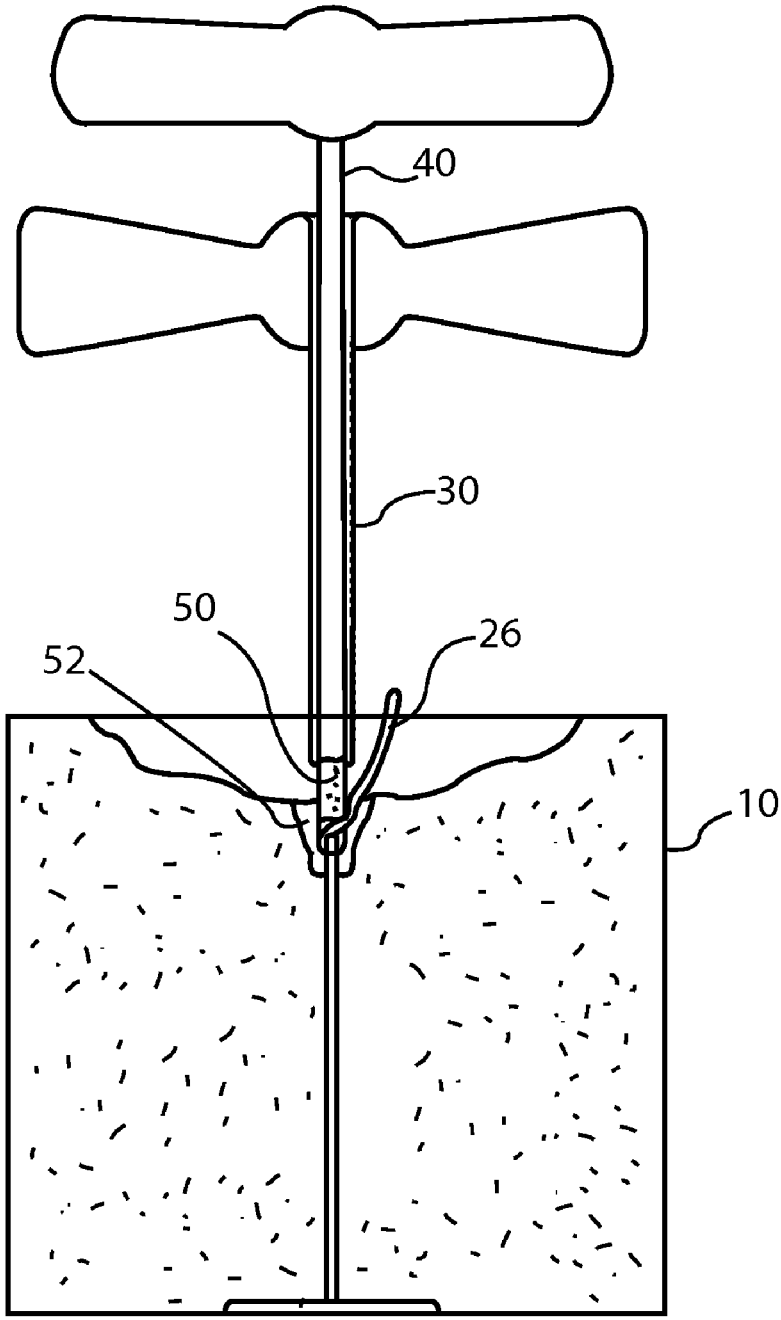
FIG. 4 is a cross-sectional view of a ramrod displacing a core of wax from the coring device of FIG. 1.

Referring to FIG. 4, it can be seen that once the new length of replacement wick 26 in set into place, the hollow shaft 30 of the coring device 20 is again advanced into the bore 52. The bore 52 is wider than the hollow shaft 30 due to the wobbling of the hollow shaft 30 during the creation of the bore 52. This leaves room for the new length of replacement wick 26 to be displaced to the side while the hollow shaft 30 advances. Once the hollow shaft 30 is positioned near the bottom of the bore 52, the solid shaft 40 of the ramrod 22 is inserted into the top of the hollow shaft 30 of the coring device 20. The handle 34 of the coring device 20 is pressed toward the handle 42 of the ramrod 22 like a syringe.

From FIG. 4, it can be seen that the solid shaft 40 of the ramrod 22 presses the core cutting 50 out of the hollow shaft 30 of the coring device 20 as the hollow shaft 30 is retracted out of the candle 10. The core cutting 50 is therefore reset into the bore 52. The length of replacement wick 26 is displaced to one side of the core cutting 50. However, due to the narrowness of the bore 52 and the core cutting 50, the length of replacement wick 26 remains generally aligned with the original wick 12.

Figure 5:
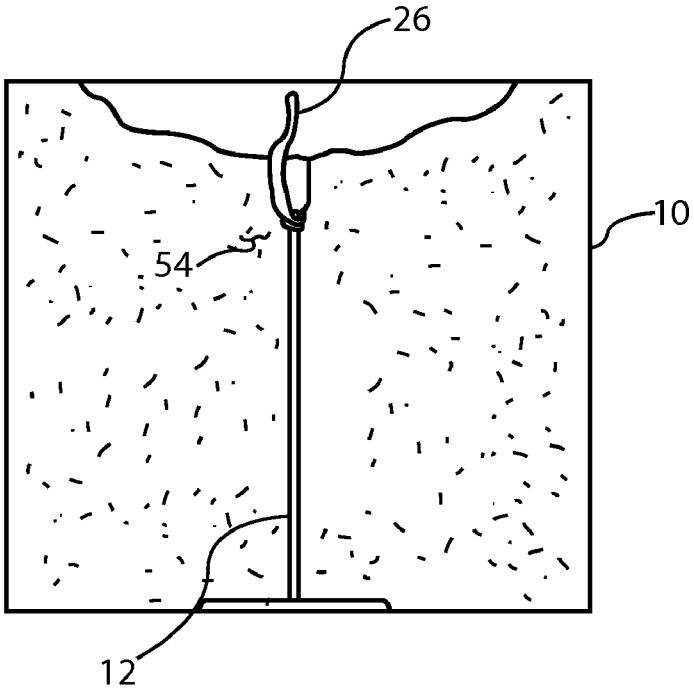
FIG. 5 is a cross-sectional, view of a repaired wax candle.

Lastly, referring to FIG. 5, it can be seen that the portion of the replacement wick 26 that protrudes from the top of the candle is trimmed to a length of preferably no longer than a fourth of an inch. When the candle 10 is lit, the replacement wick 26 will burn and will consume the wax of the candle 10 until the replacement wick 26 reaches an overlap region 54 with the primary wick 12. Once the flame reaches this overlap region 54, both the replacement wick 26 and the primary wick 12 will burn. However, since the replacement wick 26 and the primary wick 12 are essentially at the same position, only a single flame will burn. Once the replacement wick 26 is spent, the candle 10 will again burn using the primary wick 12.

It will be understood that the embodiment of the present invention system and method that is illustrated is merely exemplary and that a person skilled in the art can make many variations to the shown embodiment without departing from the scope of the claims. For instance, there are many coring devices used to cut cores from material. Many such coring devices have cutting heads that differ from that used in the exemplary embodiment, yet can be substituted for the exemplary cutting head. Furthermore, the handles used on the coring assembly and the ramrod assembly are a matter of design choice and can be altered in shape, size and location. All such variations, modifications and alternate embodiments are intended to be included as part of the present invention as defined by the claims.

What is claimed is:

1. A method of repairing a wax candle having a diminished wick, said method comprising the steps of:

providing a coring device containing a hollow shaft that defines an open conduit between a first open end and a second open end, said coring device further containing a handle that is coupled to said hollow shaft proximate said open second end, wherein said handle does not obstruct said second open end;

providing a ramrod sized to fit into said open conduit of said hollow shaft;

cutting a core from said candle around said diminished wick by advancing said first open end of said hollow shaft into said candle around said diminished wick, wherein said core is retained in said hollow shaft;

removing said core from said candle by removing said hollow shaft from said candle, therein creating a bore in said candle;

placing a new wick in said bore;

ejecting said core from said hollow shaft by advancing said ramrod into said hollow shaft and displacing said core out of said shaft, and replacing said core into said bore.

2. The method according to claim 1, wherein said step of replacing said core into said bore, includes inserting said hollow shaft back into said bore and displacing said core out of said hollow shaft directly into said bore.

3. A method of adding a length of wick to a wax candle, comprising the steps of:

providing a coring device containing a hollow shaft that defines an open conduit between a first open end and a second open end, said coring device further containing a handle that is coupled to said hollow shaft proximate said open second end, wherein said handle does not obstruct said second open end;

providing a ramrod sized to fit into said open conduit of said hollow shaft;

cutting a bore into the wax candle using said coring device, therein producing removed wax cuttings;

inserting a length of wick into said bore, wherein said length of wick protrudes out of said bore, filling said bore with said removed wax cuttings.

4. The method according to claim 3, wherein said wax candle has an existing wick and said step of cutting a bore includes exposing at least a portion of said existing wick.

5. The method according to claim 3, wherein said step of cutting a bore into said candle includes inserting said hollow shaft into said candle, wherein said hollow shaft internally receives said removed wax cuttings.

6. The method according to claim 5, wherein said step of cutting said bore includes withdrawing said hollow shaft from said candle while containing said removed wax cuttings.

7. The method according to claim 3, wherein said step of filling said bore, includes inserting said ramrod into said hollow shaft and displacing said removed wax cuttings from said hollow shaft.

8. The method according to claim 7, wherein said step of filling said bore, includes inserting said hollow shaft back into said bore and displacing said removed wax cuttings out of said hollow shaft directly into said bore.

* * * * *